US005757351A

United States Patent [19]

Lin et al.

[11] Patent Number: 5,757,351

[45] Date of Patent: May 26, 1998

[54] ELECTRODE STORAGE DISPLAY ADDRESSING SYSTEM AND METHOD

[75] Inventors: Jun Lin; Homer L. Webb; Linda S. Walling; Barry E. Young, all of Austin, Tex.; J. Scott Denko, Shoreline, Wash.

[73] Assignee: Off World Limited, Corp., Austin, Tex.

[21] Appl. No.: 570,643

[22] Filed: Dec. 11, 1995

Related U.S. Application Data

[63] Continuation-in-part of Ser. No. 541,633, Oct. 10, 1995.

[51] Int. Cl.[6] ..... G09G 3/36

[52] U.S. Cl. ..... 345/98; 345/100

[58] Field of Search ..... 345/87, 88, 89, 345/98, 99, 100, 103, 92, 93, 211, 212, 213; 348/790, 791, 792, 793; 349/33, 34

[56] References Cited

U.S. PATENT DOCUMENTS

| | | | |
|---|---|---|---|
| 3,716,658 | 2/1973 | Rackman | 178/7.3 D |
| 3,787,834 | 1/1974 | Elliott | 340/324 M |
| 3,975,085 | 8/1976 | Yamada | 350/160 LC |
| 4,005,402 | 1/1977 | Amano | 340/324 |
| 4,110,662 | 8/1978 | Greeneich et al. | 315/169 TV |
| 4,234,821 | 11/1980 | Kako et al. | 315/169.3 |
| 4,306,234 | 12/1981 | Mayer | 340/769 |
| 4,308,609 | 12/1981 | Stroomer | 340/702 |
| 4,322,720 | 3/1982 | Hughes | 340/825.81 |
| 4,429,305 | 1/1984 | Hosokawa et al. | 340/784 |
| 4,447,812 | 5/1984 | Soneda et al. | 340/784 |
| 4,450,720 | 5/1984 | Person et al. | 340/773 |
| 4,531,122 | 7/1985 | Redfield | 340/781 |
| 4,779,085 | 10/1988 | Mizutome et al. | 340/805 |
| 4,789,223 | 12/1988 | Kasahara et al. | 350/333 |
| 4,799,057 | 1/1989 | Takeda et al. | 340/811 |
| 4,804,951 | 2/1989 | Yamashita et al. | 340/719 |
| 4,816,819 | 3/1989 | Enari et al. | 340/811 |
| 4,818,991 | 4/1989 | Gay | 340/784 |
| 4,823,126 | 4/1989 | Nagata et al. | 340/825.79 |
| 4,833,464 | 5/1989 | Di Santo et al. | 340/793 |
| 4,870,399 | 9/1989 | Carlson | 340/811 |
| 4,881,066 | 11/1989 | Kanno et al. | 340/719 |
| 4,890,101 | 12/1989 | Carlson | 340/811 |
| 4,896,149 | 1/1990 | Buzak et al. | 340/794 |
| 4,922,240 | 5/1990 | Duwaer | 340/784 |

(List continued on next page.)

FOREIGN PATENT DOCUMENTS

| | | |
|---|---|---|
| 0304990A2 | 8/1988 | European Pat. Off. . |
| 0493820A1 | 12/1991 | European Pat. Off. . |
| WO91/17537 | 11/1991 | WIPO . |

*Primary Examiner*—Xiao Wu
*Attorney, Agent, or Firm*—J. Scott Denko

[57] ABSTRACT

The present invention uses temporary storage of data sub-frames to obviate the need for a multiplicity of driver circuit packages and eliminate the traditional one-to-one association of driver circuit channels with selected data electrodes in the addressing of a flat panel display matrix. Display data signals are serially induced along a controlled velocity signal propagation transmission line to create signal profiles representative of data sub-frames, a data frame being the amount of data required to address a single display row. Individual informational "bits" of the data sub-frame are captured, in timed sequence or in parallel, from the signal profile by the multiplexer assemblies tapped into the transmission line at particular sites along its length. When the assemblies are enabled, the signal profile along the transmission line is exposed to a charge storage capability. The informational bits of the signal profile representing the sub-frame are, consequently, captured. Sequential capturing and storage of data sub-frames continues until a complete data frame of matrix information has been stored. When the bits of plural sub-frames sufficient in total to address an entire row have been stored, the stored data frame is available on the column electrodes and a row select strobe signal closes an electrical path between the multiple data sub-frames available from the columns and a selected row thus recomposing the full data frame at the strobed row to display the data.

2 Claims, 13 Drawing Sheets

U.S. PATENT DOCUMENTS

| | | | |
|---|---|---|---|
| 4,931,787 | 6/1990 | Shannon | 340/784 |
| 4,935,670 | 6/1990 | Watanabe | 315/169.1 |
| 4,963,860 | 10/1990 | Stewart | 340/719 |
| 4,982,272 | 1/1991 | Brody | 358/59 |
| 5,021,774 | 6/1991 | Ohwada et al. | 340/811 |
| 5,061,920 | 10/1991 | Nelson | 340/784 |
| 5,086,257 | 2/1992 | Gay et al. | 315/169.4 |
| 5,095,304 | 3/1992 | Young | 340/766 |
| 5,107,182 | 4/1992 | Sano et al. | 315/169.4 |
| 5,113,181 | 5/1992 | Inoue et al. | 340/783 |
| 5,131,065 | 7/1992 | Briggs et al. | 385/120 |
| 5,151,689 | 9/1992 | Kabuto et al. | 340/784 |
| 5,151,805 | 9/1992 | Takeda et al. | 359/57 |
| 5,166,671 | 11/1992 | Mackawa | 340/784 |
| 5,170,158 | 12/1992 | Shinya | 340/800 |
| 5,202,674 | 4/1993 | Takemori et al. | 340/781 |
| 5,250,931 | 10/1993 | Misawa et al. | 345/206 |
| 5,359,343 | 10/1994 | Nakamura | 345/100 |
| 5,426,447 | 6/1995 | Lee | 345/103 |
| 5,510,807 | 4/1996 | Lee et al. | 345/103 |
| 5,519,414 | 5/1996 | Gold et al. | 345/99 |

ELECTRODE STORAGE DISPLAY ADDRESSING SYSTEM AND METHOD

RELATED APPLICATIONS

This is a continuation-in-part of U.S. patent application Ser. No. 08/541,633, filed Oct. 10, 1995.

TECHNICAL FIELD

The present invention relates to visual display systems and, in particular, to a method and apparatus for addressing high information content matrix visual displays.

BACKGROUND OF THE INVENTION

A flat panel display comprises multiple display elements distributed across a viewing area of a display surface. One type of flat panel display system directly multiplexes a plurality of display cells, such as liquid crystal cells ("LCD") for example, or other display elements arranged in a matrix array. The cells are arranged between electrodes that apply electrical signals across the cell to change the optical characteristics of the cell. This type of system is known as "passive" because there are no active elements used to change the optical characteristics of the cell.

Other display systems associate separate solid state devices such as transistors, for example, with each cell or "pixel" to increase pixel isolation and effective nonlinear response to applied signals. Such systems are known as "active" matrix displays. Active display addressing structures typically employ a two- or three-terminal solid state device with each cell. Diodes are used in two-terminal addressing structures and transistors, such as thin-film transistors ("TFT") for example, are typically used in three-terminal addressing structures. Storage devices may also be associated with each pixel site to increase individual cell and total display matrix capacitance and switching response.

High information content displays, such as those used in computer monitors, require a large number of pixels to appropriately display complex textual or graphical information patterns. Matrix displays, such as those using LCD's for example, are fabricated in a variety of formats. A typical black and white format includes 640 column electrodes and 480 row electrodes ("640×480") perpendicularly crossed to access 307,200 display pixels. The 640×480 format is referred to as video graphics array or VGA format. Many other formats having other densities are available. For example, the XGA format includes 1024 column electrodes and 768 row electrodes. In the near future, matrix LCD's may soon comprise millions of pixels to increase image resolution and gray scale range.

In a color-responsive matrix visual display, the three color data signals of RED, GREEN, and BLUE ("RGB") are articulated with three sub-pixels aggregated for each pixel site. Consequently, a color-responsive display matrix includes three times as many column electrodes as a black and white display matrix of similar format. For example, rather than 640 column electrodes, there are 1920 column electrodes in a color-responsive VGA format display system matrix.

Typically, the column and row electrodes cross and, in an active display matrix, are electrically associated through an active device. In an active matrix color responsive VGA matrix for example, there 480 active devices on each of the 1920 column electrodes for a total of 921,00 active devices, each of which is typically associated with a selected display sub-pixel.

In a 640×480 active matrix LCD color display, 480 TFT's corresponding to the 480 rows of the display matrix are arranged along each of the 1920 columns.

Consequently, a signal applied to a selected column appears on the drain of each of the 480 TFT's arranged along the column. The gate of a selected TFT arranged along the selected column are controlled by electrical signals applied to the row crossing the selected column at pixel or sub-pixel site corresponding to the selected TFT. Therefore, the state of any one of the 921,600 TFT's (and associated storage elements, if any) in a 640×480 active matrix color display may be switched by the application and intersection of a particular data signal applied to a selected column with a particular selection signal applied to a selected row.

Whether a passive or active display matrix is addressed, an extensive driving circuitry is required however, to address the nearly one million sub-pixels arranged to selectively actuate the 307,200 pixels of a typical 640×480 color-responsive LCD matrix display. In a typical 640×480 high information content display, 1920 data signals are applied in parallel to the 1920 column electrodes. Contemporary circuit integration and packaging technologies are unable to provide a single package having 1920 signal lines. Consequently, traditional solutions have combined several high density digital to analog signal driver packages to provide, in aggregate, the 1920 data signals required to address a 640×480 color responsive display matrix. A common arrangement employs eight digital to analog driver packages each having 240 output channels to provide the 1920 data signals required.

When signal drivers are aggregated in a display system, costs rise proportionally. In a typical VGA 640×480 LCD color responsive display system, the eight 240-channel driver packages required to address the 1920 column electrodes represent a material portion of the entire display cost. Multiple driver circuits also increase exposure to reliability problems while consuming power and adding incremental weight and complexity to the display to the detriment of systems using flat panel displays.

What is needed therefore, is an apparatus and method for addressing a high information content matrix display with a minimal number of driver circuits.

SUMMARY OF THE INVENTION

An object of the present invention is, therefore, to provide a system and method to reduce the number of signal driver circuits required to address a high information content display matrix.

Another object of this invention is to provide a flat panel display system having efficient use of driver circuitry with high-speed addressing capabilities.

A further object of this invention is to provide a method and apparatus having reduced driver circuit requirements and consequent appreciable cost savings with simple articulation adaptable to a variety of display matrix densities and formats.

In the description of the present invention, a data frame is the data sufficient to address an entire row of a display matrix. A data sub-frame may be any amount of data less than a data frame. The present invention uses temporary storage of data sub-frames to obviate the need for a multiplicity of driver circuit packages and eliminate the traditional one-to-one association of driver circuit channels with selected data electrodes in the addressing of a flat panel display matrix.

Display data signals are serially induced along a controlled signal velocity propagation transmission line to create standing signal profile representations of data sub-frames. Multiplexer circuits positioned along the transmission line capture the constituent "bits" of data sub-frames from the standing signal profile and temporarily store the captured bits in capacitive storage individually associated with display electrodes. When a complete data frame is stored, a selected row is enabled transferring the stored bits from the capacitive storage to the display elements along the selected row to display the data. Because data drivers are required only at transmission line terminal ends, the demands for driver multiplicity are greatly reduced.

The multiplexer circuits selectively present charge-storage capability to the sub-frame bits to be captured from the signal profile along transmission line. In a preferred embodiment, the transmission line is selectably exposed to charge storage by a series of multiplexer assemblies positioned along the transmission line. Each assembly is interpoised between the transmission line and a set display matrix electrodes. The assemblies may be discrete circuits or integrated into single or multiple packages. When the assemblies are enabled, the signal profile along the transmission line is exposed to the charge storage capability. The bits of the signal profile representing the sub-frame are, consequently, captured. The captured bits are deposited in a set of digitally selected storage elements associated with the display matrix column electrodes. After the first sub-frame of a data frame has been stored, a second data sub-frame is induced as a standing signal profile on the controlled signal velocity transmission line. The assemblies capture the second sub-frame for conveyance to and storage on a second set of column related storage elements. Sequential capturing and storage of data sub-frames continues until a complete data frame of matrix information has been stored. When the bits of plural sub-frames sufficient in total to address an entire row have been stored, the stored data frame is available on the column electrodes and a row select strobe signal closes an electrical path between the multiple data sub-frames available from the columns and a selected row thus recomposing the full data frame at the strobed row to display the data.

In a preferred embodiment, for example, data signals are serially induced along a controlled signal velocity propagation transmission line ("the transmission line"). The transmission line is devised to exhibit a propagation constant sufficient to slow the propagation velocity of the induced data signals to a useful velocity. Consequently, during a particular time window, a unique data sub-frame is resident as a signal profile along the transmission line. Multiplexers positioned along the transmission line access the signal profile populating the transmission line. Individual "bits" of the data sub-frame are captured, in timed sequence or in parallel, from the signal profile by the multiplexers tapped into the transmission line at particular sites along its length. In a preferred embodiment, an assembly of nested multiplexer circuits and charge storages is connected to each transmission line tap site. The assemblies correspond to the bits of a sub-frame. There are the same number of multiplexer assemblies as bits in the sub-frames induced along the transmission line. Consequently, each assembly along the transmission line is designated to capture the selected bit from the signal profile corresponding to the position of the assembly along the transmission line. When the transmission line is populated by a signal profile representative of the sub-frame to be captured and stored, the first level circuit of each assembly is enabled, capturing the bit from the profile corresponding to the position of that assembly along the transmission line. For example, the assembly nearest a terminal end of the transmission line is designated to capture and store the corresponding terminal bit of the resident sub-frame signal profile.

Each level of the multiplexer assemblies positioned along the transmission line includes associated charge storage. Although some embodiments may employ to advantage other numbers of levels, two multiplexer and charge storage levels are employed by each multiplexer assembly in a preferred embodiment of the present invention. The two levels of multiplexing and storage allow the data frames to be pipelined. On the first storage level, the charge storage is articulated into storage elements uniquely corresponding to individual display matrix column electrodes. The second level storage is provided by the inherent charge storage capability of the column electrodes and may be supplemented by supplemental capacitors appended to the column electrodes.

Each assembly captures a bit designated by position in the sub-frame profile corresponding to the position of the assembly along the transmission line. The captured bit is stored in one of several first level storage elements available to each assembly by designated sub-frame sequence according to a digital selection code provided to the first level multiplexer. After all the bits of a data frame have been stored in first level storage, the second multiplexer level is enabled to transfer the bits from the first level to the second level storage comprising the charge storage capacity of the individual charge storable column electrodes and any supplemental storage elements. When the data has been transferred to the second level storage, the second multiplexer level is disabled isolating the bit on the column electrodes. A selected row is enabled conveying the bit from the column electrodes to the display elements associated with the selected row for display. During the time the selected row is reaching the on state, the data for the next data frame is being processed by the first level of the multiplexer assemblies. Consequently, row addressing time is fully exploited and the row has a complete period to reach the on state while subsequent data frames are being processed.

As an example, if a frame is divided into sixteen sub-frames, the second bit of the third sub-frame is captured by the second assembly along the transmission line and stored in the third of the set of sixteen storages associated with the second assembly. Similarly, the second assembly stores the second bit of the fourth sub-frame in the fourth of the set of sixteen storages associated with the second assembly. After all the bits comprising a full frame of data have been stored, the second level of the assemblies transfers the stored frame to the individual column electrodes where the data is available for display when a selected row is enabled. The dual level multiplexers and storage capabilities allow simultaneous use of frame time. While the first level of the assemblies is capturing and storing a data frame, the prior data frame is available for transfer from the charge storable columns to an enabled row for display.

A variety of transmission line and multiplexer configurations may be devised to utilize the method and apparatus of the present invention to reduce the number of driving circuits required to address a high information display matrix. Data signals may be induced on one or both ends of a transmission line to compose signal profiles for capture and storage. Multiple transmission lines may be employed and both the rows and columns of a display matrix may be addressed in accordance with the invention. A variety of timing schemes may be employed to regulate aggregate screen potentials to enhance visual contrast. The number of levels within an assembly may be selected to fabricate a structure amenable to multiple algorithmic techniques and the number of assembly taps may be chosen to mitigate any signal dispersion effects associated with particular transmission line constraints. Known and new compensation techniques are adaptable to the present invention to mitigate individual variations across addressed structures and transmission lines.

DETAILED DESCRIPTION OF PREFERRED EMBODIMENTS

Figure 1:
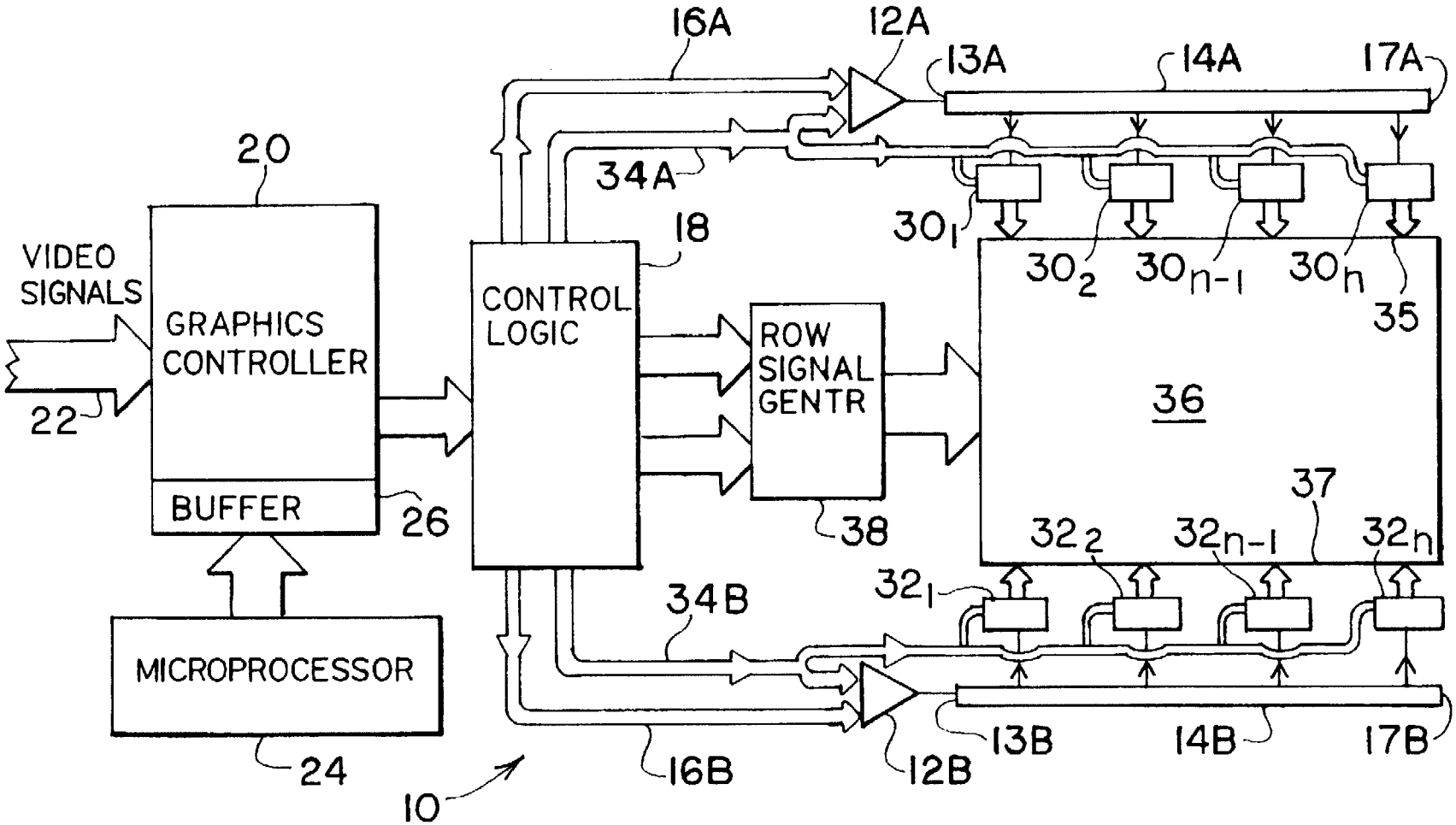
FIG. 1 depicts a block diagram of a flat panel display system employing the present invention.

A new addressing method and apparatus for high information content display systems are provided in accordance with the present invention. FIG. I is a block diagram of a flat panel display system 10 illustrating the present invention in the addressing of a flat panel display matrix. As shown in FIG. 1, system 10 employs two signal drivers 12A and 12B to induce a serial data stream upon corresponding controlled signal velocity propagation transmission lines (the "transmission lines") 14A and 14B. The serial data streams may be induced at ends 13A and 13B or at ends 17A and 17B. Complementary data streams are supplied to drivers 12A and 12B by data buses 16A and 16B from control logic 18 and graphics controller 20. Video data may be supplied by video signal stream 22 or microprocessor 24 through optional buffer 26. A variety of drivers may be employed as drivers 12A and 12B. In a preferred embodiment, an E'lantec EL2260C/EL2460C model 130 MHz current feedback amplifier is used as drivers 12A and 12B. However, as those skilled in the art recognize, high bandwidth, high frequency amplifiers of many different types will satisfy the requirements presented by drivers 12A and 12B.

The induced serial data streams populate the respective transmission lines 14A and 14B with signal profiles representative of the induced data. Signal profiles populating transmission line 14A are accessible to multiplexer assemblies $\mathbf{30}_1$–$\mathbf{30}_n$, and the signal profiles resident on transmission line 14B are accessible to multiplexer assemblies $\mathbf{32}_1$–$\mathbf{32}_n$ positioned along transmission line 14B. When signal profiles representative of complementary sub-frames becomes resident on transmission lines 14A and 14B, the multiplexer assemblies $\mathbf{30}_1$–$\mathbf{30}_n$ and $\mathbf{32}_1$–$\mathbf{32}_n$ are enabled by control logic 18 through timing and selection buses 34A and 34B. When enabled, multiplexer assemblies $\mathbf{30}_1$–$\mathbf{30}_n$ and $\mathbf{32}_1$–$\mathbf{32}_n$ expose the signal profiles resident on transmission lines 14A and 14B to charge storage capacitance elements associated with the column electrodes of display matrix 36. When a complete data frame has been stored by the sequential capturing and storage of data sub-frames, a selected row of matrix 36 is enabled by row signal generator 38, thus recomposing the data frame at the selected row to display the data.

Traditionally, display matrices of the type represented by display matrix 36 of FIG. 1, have been constructed to give access to half of the column electrodes along a peripheral edge 35 and access to the other half of the column electrodes along the opposite peripheral edge 37 of matrix 36. Consequently, FIG. 1 shows the two transmission lines 14A and 14B placed proximal to peripheral edges 35 and 37 respectively. In the system of FIG. 1, when display matrix 36 is a 640×480 black-and-white VGA display matrix, the 320 column electrodes identifiable as C1, C3, C5, * * * C639 are accessible to multiplexer assemblies $\mathbf{30}_1$–$\mathbf{30}_n$, and the 320 column electrodes numbered C2, C4, C6, * * * C640 are accessible to multiplexer assemblies $\mathbf{32}_1$–$\mathbf{32}_n$. Those skilled in the art will recognize that many other display formats and densities may be addressed through variations in the placement and number of transmission lines, as well as the number of multiplexer assemblies such as those typified by assemblies $\mathbf{30}_1$–$\mathbf{30}_n$ and $\mathbf{32}_1$–$\mathbf{32}_n$. For example, the transmission lines may be positioned only along one peripheral edge of display matrix 36 in systems devised to address contemporary matrices having columnar access through only one peripheral edge. Where color displays having large numbers of column electrodes are addressed, embodiments employing several transmission lines may devised to utilize the present invention.

With continuing reference to FIG. 1, multiplexer assemblies $\mathbf{30}_1$–$\mathbf{30}_n$ and $\mathbf{32}_1$–$\mathbf{32}_n$ are positioned along the respective transmission lines 14A and 14B in correspondence with the position various bits of the induced data sub-frame occupy when a signal profile representative of the induced sub-frame becomes resident on the transmission line. Consequently, each of multiplexer assemblies $\mathbf{30}_1$–$\mathbf{30}_n$ and $\mathbf{32}_1$–$\mathbf{32}_n$ corresponds to bits of a particular position location within each induced signal profile representative of a sub-frame of data. For example, multiplexer assembly $\mathbf{30}_2$ is positionally designated to correspond to the second bit from end 13A of transmission line 14A of each sub-frame induced on transmission line 14A. In a preferred embodiment, there are as many multiplexer assemblies $\mathbf{30}_1$–$\mathbf{30}_n$ as there are bits in the sub-frames made sequentially resident on transmission line 14A. Similarly, there are as many multiplexer assemblies $32_1$–$32_n$ as there are bits in the sub-frames made sequentially resident on transmission line 14B. To conserve the clarity of the exposition, the depiction of FIG. 1 represents the multiplexer assemblies as numbering from 1 to n without literally depicting all n of the multiplexer assemblies on each of lines 14A and 14B. In a preferred embodiment, where there are n multiplexer assemblies, there are n bits in each of the sub-frames composed upon transmission lines 14A and 14B. For example, if a data frame required to address a complete row of display matrix 36 requires m bits, the number of sub-frames sequentially induced on lines 14A and 14B will equal m divided by n where n is the number of multiplexer assemblies.

Each of multiplexer assemblies $30_1$–$30_n$ and $32_1$–$32_n$ is associated with a unique set of charge storage capacitance elements. To continue the organization numbering begun above, where there are m bits in a data frame and n multiplexer assemblies and, therefore, n bits in each induced sub-frame, there will be m divided by n charge storage elements available to each of the n multiplexer assemblies. Consequently, there will be a total number of m charge storage elements in system 10 where a data frame includes m bits. For example, to address a black-and-white 640×480 VGA display matrix 36 having 640 column electrodes, transmission line 14A would be employed to address the 320 column electrodes of display 36 available along peripheral edge 35 and transmission line 14B would be employed to address the 320 column electrodes available along peripheral edge 37. If system 10 employs ten multiplexer assemblies 30 and ten multiplexer assemblies 32, each of multiplexer assemblies $30_1$–$30_{10}$ and $32_1$–$32_{10}$ will have thirty-two available charge storage elements.

Figure 2:
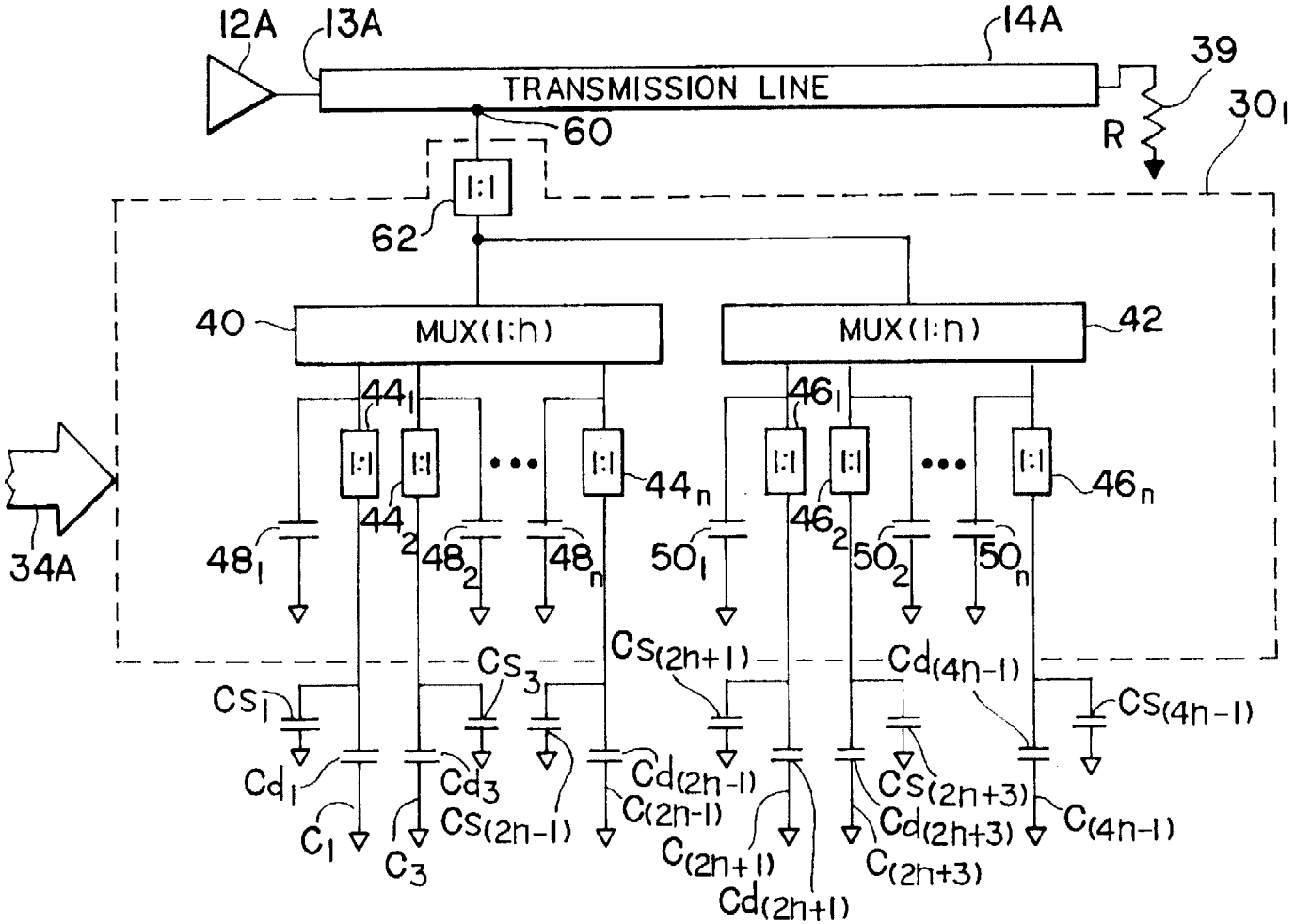
FIG. 2 depicts an exemplar two-level multiplexer assembly and associated charge storage elements in a preferred embodiment of the present invention.

FIG. 2 depicts exemplar multiplexer assembly $30_1$ and its associated charge storage elements in preferred embodiments of this invention that employ available packaged multiplexers in the addressing of VGA display matrices. Those skilled in the art will recognize that multiple multiplexer circuits may be integrated to increase the selectable capacity of each assembly and, therefore, the number of electrodes addressable by each assembly.

With reference to FIG. 2, multiplexer assembly $30_1$ is shown appended to transmission line 14A. For clarity of exposition, assemblies $30_2$–$30_n$ are not shown in FIG. 2, but it is to be recognized that, in a preferred embodiment, assemblies $30_2$–$30_n$ may be similarly understood and arranged along transmission line 14A, just as assemblies $32_1$–$32_n$ may be similarly understood and arranged along transmission line 14B. Driver 12A serially drives a data sub-frame on transmission line 14A at end 13A to establish a signal profile comprising informational bits representative of the driven sub-frame. A data frame is the data required to address a complete row of matrix 36 and a data sub-frame may be any amount of data less than a data frame. To reduce signal reflections, transmission line 14A is terminated by termination impedance 39. Assembly $30_1$ is positioned to have access to the designated informational bit of the established signal profile nearest end 13A.

Assembly $30_1$ of FIG. 2 comprises two levels of multiplexers. Level one is comprised of one-to-n selection multiplexers 40 and 42, and level two is comprised of one-to-one multiplexers depicted for assembly $30_1$ in FIG. 2 as multiplexers $44_1$–$44_n$ and $46_1$–$46_n$. As discussed above with reference to FIG. 1, system 10 is described with reference to a 640×480 black-and-white VGA display matrix 36. Consequently, transmission line 14A has access to the "odd" half of the 640 column electrodes. Those "odd" electrodes may be identified as $C_1$, $C_3$, $C_5$, $C_7$ * * *$C_{639}$. Consequently, where multiplexers 40 and 42 are one-to-n multiplexers, storage elements $48_1$–$48_n$ are individually associated with columns $C_1$, $C_3$, * * * $C_{(2n-1)}$ through one-to-one multiplexers $44_1$–$44_n$ and storage elements $50_1$–$50_n$ are individually associated with columns $C_{(2n+1)}$, $C_{(2n+3)}$, * * * $C_{(4n-1)}$ through one-to-one multiplexers $46_1$–$46_n$. A depiction of multiplexer assembly $32_1$ along transmission line 14B would show association of storage elements with "even" numbered column electrodes.

Storage elements $48_1$–$48_{16}$ and $50_1$–$50_n$ are, in a preferred embodiment, non-polar capacitors each having storage capacity of about 100 pF. The storage elements $48_1$–$48_n$ and $50_1$–$50_n$ comprise a first storage level in multiplexer assembly $30_1$. A final storage level accessible from assembly $30_1$ is provided by the inherent distributed storage capacity associated with column electrodes depicted in FIG. 2 as capacitive elements $Cd_1$, $Cd_3$, * * * $Cd_{(2n-1)}$ and $Cd_{(2n+1)}$, $Cd_{(2n+3)}$, * * * $Cd_{(4n+1)}$. In a typical LCD matrix 36, elements $Cd_1$, $Cd_3$, * * * $Cd_{(sn-1)}$ and $Cd_{(2n+1)}$, $Cd_{(2n+3)}$, * * * $Cd_{(4n-1)}$ each have a capacitance of approximately 50 pF. The inherent distributed storage capacity of column electrodes may optionally be supplemented as shown in FIG. 2 by the storage elements $CS_1$–$Cs_{(2n-1)}$ and $Cs_{(2n+1)}$–$Cs_{(4n-1)}$ which, in a preferred embodiment, are non-polar capacitors each having capacitance of 100 pF.

A significant OFF capacitance of approximately 130 pF may be presented to transmission line 14A when standard multiplexers are used as multiplexers 40 and 42. Consequently, to reduce the OFF capacitance presented to line 14A when an embodiment employing standard, "off-the-shelf" multiplexers is devised, it is preferred to interpoise a one-to-one multiplexer 62 between tap site 60 and multiplexers 40 and 42 as shown in FIG. 2. Multiplexer 62 is to be enabled with multiplexers 40 and 42. However, when an integrated set of multiplexers comprising assembly $30_1$ is fabricated, sufficiently low OFF capacitances may be presented to dispense with multiplexer 62. The second level of multiplexers $44_1$–$44_n$ and $46_1$–$46_n$ provide data pipeline capability for the present invention. Timing and selection bus 34A provides timing signals to multiplexer levels one and two and digital selection signals to multiplexer level one.

Figure 3:
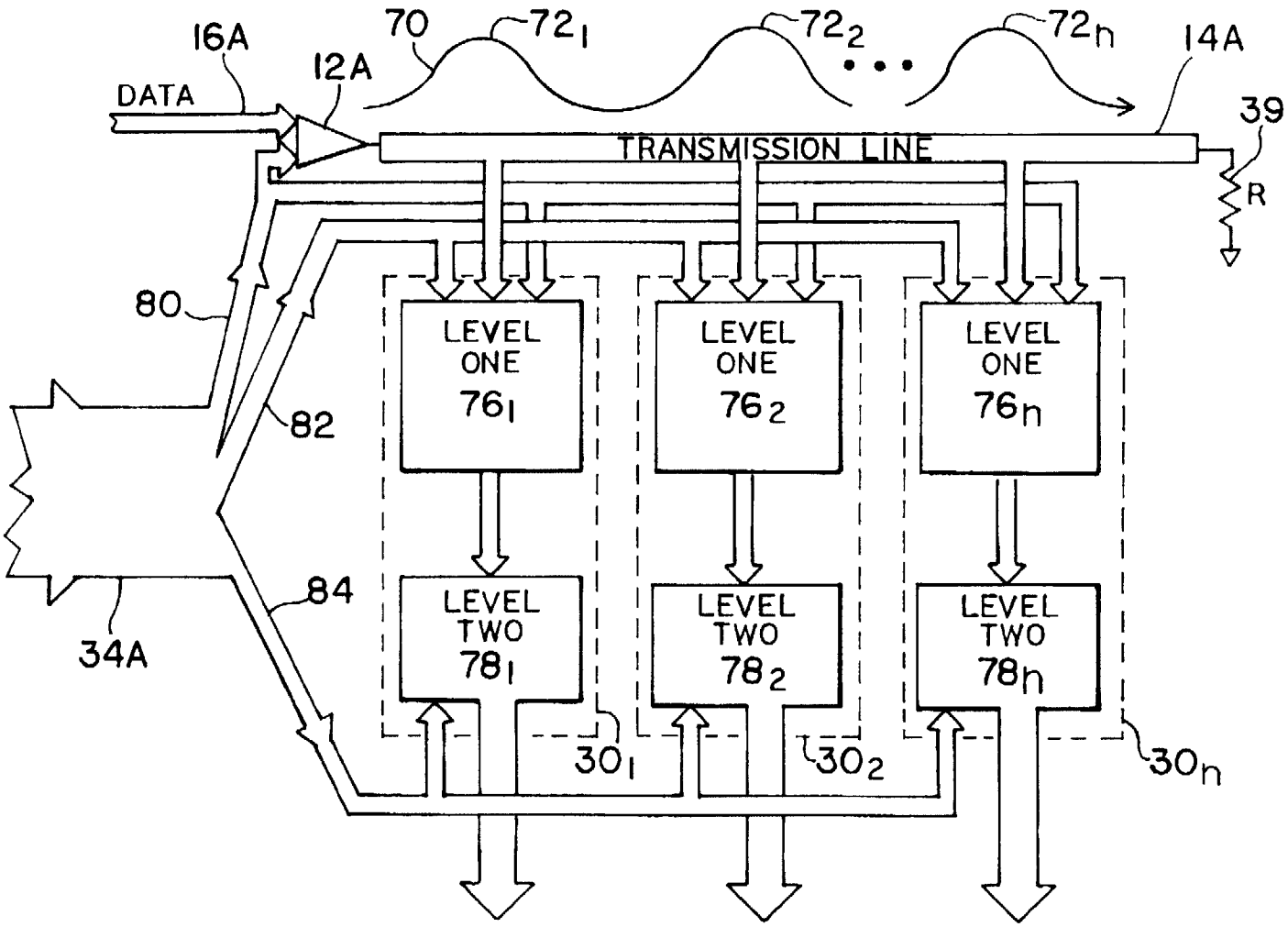
FIG. 3 is a block diagram illustrating the relationship between two multiplexer levels of multiplexer assemblies in a preferred embodiment of this invention.

With reference to FIG. 3, multiplexer assemblies $30_1$–$30_n$ are shown appended to transmission line 14A. Driver 1 2A serially drives data sub-frames upon transmission line 14A to sequentially establish standing signal profiles 70 representative of driven data sub-frames. Signal profile 70 exhibits waveform pulses or informational bits $72_1$–$72_n$ representative of the induced sub-frame data. Assembly $30_1$ is positioned along transmission line 14A to have, at a particular time, access to informational bit $72_1$ of each signal profile 70 established along line 14A. Assembly $30_2$ is positioned along transmission line 1 4A to have access to informational bit $72_2$ of signal profile 70. Subsequent assemblies are correspondingly positioned. Assembly $30_n$ is positioned therefore, to have access to informational bit $72_n$. Transmission line 14A is terminated with termination impedance 39, which, in a preferred embodiment matches the impedance of transmission line 14A.

The description proceeds with reference to FIGS. 2 and 3. FIG. 3 depicts the application of enable and selection signals to multiplexer assemblies $30_1$–$30_n$ in a preferred embodiment of the present invention. Multiplexer assemblies $30_1$–$30_n$ comprise two multiplexer levels. Although FIG. 3 depicts assemblies $30_1$–$30_n$ positioned along transmission line 14A, it is to be understood that, in systems devised in accordance with the present invention, multiplexer assemblies may, but need not, be similarly structured. For example, multiplexer assemblies in other preferred embodiments, such as those assemblies depicted in FIG. 6, may employ one level of multiplexer circuitry.

With continuing reference to FIG. 3, level one $76_1$–$76_n$ is comprised of multiplexers corresponding to those depicted in FIG. 2 as multiplexers 40 and 42 and storage elements $48_1$–$48_{16}$ and $50_1$–$50_n$ and level two $78_1$–$78_n$ is comprised of one-to-one multiplexers corresponding to those shown as multiplexers $44_1$–$44_n$ and $46_1$–$46_n$ in FIG. 2. As shown in FIG. 3, bus 34A provides selection and timing enable signals to multiplexer assemblies $30_1$–$30_n$ in coordination with the inducement of signal profile 70 by driver 12A. When driver 12A has populated transmission line 14A with signal profile 70, first level enable signals are simultaneously provided level one $76_1$–$76_n$ by sub-bus 80. When enabled, level one $76_1$–$76_n$ capture bits by designated site along transmission line 14A. For example, when signal profile 70 is induced on transmission line 14A, level one $76_1$–$76_n$ are simultaneously enabled and level one $76_1$ of assembly $30_1$ captures bit $72_1$ and level one $76_2$ of assembly $30_2$, captures bit $72_2$ from transmission line 14A. Assemblies $30_3$–$30_n$ capture corresponding bits from signal profile 70 according to designated position along transmission line 14A.

Selection signals are provided to level one $76_1$–$76_n$ by sub-bus 82. In assembly $30_1$, the provided selection signals are employed by multiplexers 40 and 42 determine to which of the storage elements $48_1$–$48_{16}$ and $50_1$–$50_n$ a particular captured bit will be directed by multiplexers 40 and 42 respectively. The provided selection signals are similarly employed by assemblies $30_2$–$30_n$. Those skilled in the art will recognize that a variety of storage schemes may be articulated by varying the selection signals provided to assemblies $30_1$–$30_n$.

The selection signals are generated by control logic 18 depicted in FIG. I and may be supplied to control logic 18 by graphics controller 20. Those skilled in the art will recognize that multiplexer assemblies $30_1$–$30_n$ may be provided by unitary integrated circuits and that, therefore, level one $76_1$–$76_n$ of corresponding assemblies $30_1$–$30_n$ would be comprised of multiple multiplexer circuits arranged at one level thereby dispensing with the separate multiplexer packages typified by multiplexers 40 and 42 illustrated in FIG. 2.

With reference to FIGS. 1, 2, and 3, in a preferred embodiment, enable signals are simultaneously provided to level one $76_1$–$76_n$ of corresponding multiplexer assemblies $30_1$–$30_n$ when signal profile 70 representing a data sub-frame has been induced along transmission line 14A by driver 12A. In the preferred embodiment depicted in FIG. 1, a complementary sub-frame is simultaneously induced along transmission line 14B by driver 12B and enable signals are provided to level one of corresponding multiplexer assemblies $32_1$–$32_n$. Enablement of level one of each of assemblies $30_1$–$30_n$ and $32_1$–$32_n$ captures the bits resident along transmission lines 14A and 14B corresponding to the position of assemblies $30_1$–$30_n$ and $32_1$–$32_n$ along the respective transmission lines. For example, if a 640 bit VGA data frame is divided into 32 sub-frames to be induced along transmission lines 14A and 14B, the sub-frames for each transmission line 14A and 14B will comprise 10 bits. There will, consequently, be ten multiplexer assemblies $30_1$–$30_n$ provided along transmission line 14A to capture the ten bits of each sub-frame induced on transmission line 14A. Similarly, there will be ten multiplexer assemblies $32_1$–$32_n$ provided along transmission line 14B to capture the ten bits of each sub-frame induced on transmission line 14B. The sub-frames for transmission lines 14A and 14B are simultaneously induced by drivers 12A and 12B and level one of each of multiplexer assemblies $30_1$–$30_n$ and $32_1$–$32_n$ are enabled simultaneously when the respective transmission lines are populated with their respective signal profiles.

Because the 640 bit data frame will be induced in 32 sequences, level one of each of the multiplexer assemblies $30_1$–$30_n$ and $32_1$–$32_n$ will be enabled 32 times for each data frame. The selection signals provided by sub-bus 82 will be changed, however, each of the 32 times per data frame, to direct the sequentially captured bits to their respective storage sites selected from storage elements $48_1$–$48_{16}$and $50_1$–$50_n$ of assembly $30_1$ and corresponding storage elements of each of the other assemblies $30_2$–$30_n$ and $32_1$–$32_n$ for which the depiction of FIG. 2 is an exemplar. In a preferred simplified selection algorithm, the selection signals provided to level one of each of assemblies $30_1$–$30_n$ and $32_1$–$32_n$ directs level one to store the captured bits by sub-frame sequence. If the sub-frame sequence being captured is the first of the 32 sequences to be captured, to continue the VGA example begun above, multiplexer assembly $30_1$ is directed to select storage element $48_1$ for the deposition of the first bit captured from the first sub-frame induced along transmission line 14A in a particular data frame. The simplified algorithm would direct corresponding sequential deposition of captured bits in the storage elements $48_2$, $48_3$, $48_4$, * * * until all 32 sequences had been induced and all 32 leading bits designated for capture by assembly $30_1$ had been deposited. Simultaneously, the other multiplexer assemblies $30_2$–$30_n$ and $32_1$–$32_n$ would be directed to similarly capture each appropriate positionally designated bit from the sequentially induced signal profiles and deposit the captured bits in the storage elements available to the corresponding assemblies according to the selection sequence signals provided by sub-bus 82.

In the preferred embodiment depicted in FIG. 1, each of assemblies $30_1$–$30_n$ and $32_1$–$32_n$ has available level one storage elements corresponding to those shown as associated with assembly $30_1$ and identified in FIG. 2 as storage elements $48_1$–$48_n$ and $50_1$–$50_n$. When all of the bits comprising a complete data frame have been deposited in accordance with the selection signals provided on sub-bus 82, the multiplexers of level two $78_1$–$78_n$ are simultaneously enabled by enable signals provided by sub-bus 84 as shown in FIG. 3. As shown in the detail of FIG. 2, each of the storage elements $48_1$–$48_n$ and $50_1$–$50_n$ associated with the level one multiplexers 40 and 42, are individually associated with particular column electrodes and storage elements through one-to-one multiplexers $44_1$–$44_n$ and $46_1$–$46_n$. In a preferred embodiment, individual level one storage elements are similarly associated with designated column electrodes in assemblies $30_2$–$30_n$ and $32_1$–$32_n$. Therefore, when enable signals are provided to level two $78_1$–$78_n$ and the corresponding level two multiplexers of assemblies $32_1$–$32_n$, the informational bits previously deposited in the level one storage elements migrate to the individual column electrodes and any associated supplemental charge elements such as those identified for assembly $30_1$ in FIG. 2 as elements elements $Cs_1$–$Cs_{(2n-1)}$ and $Cs_{(2n-1)}$–$s_{(4n-1)}$. When the multiplexers of level two $78_1$–$78_n$ and the corresponding multiplexers of level two of assemblies $32_1$–$32_n$ are disabled, the informational bits are localized on the individual column electrodes and any supplemental storage elements. Consequently, the informational bits sequentially captured and stored from signal profiles corresponding to sequentially induced sub-frames are, therefore, available for conveyance from the column electrodes to the display elements along a selected row upon the enablement of the selected row.

To continue the VGA example begun above, after all 640 informational bits corresponding to a complete data frame have been deposited in the 640 individual level one storage elements, the level two multiplexers in each of assemblies $30_1$–$30_n$ and $32_1$–$32_n$ are simultaneously enabled. Consequently, the 640 informational bits stored in the first level storage elements migrate to the individual columns and any appended supplemental storage elements.

Figure 4:
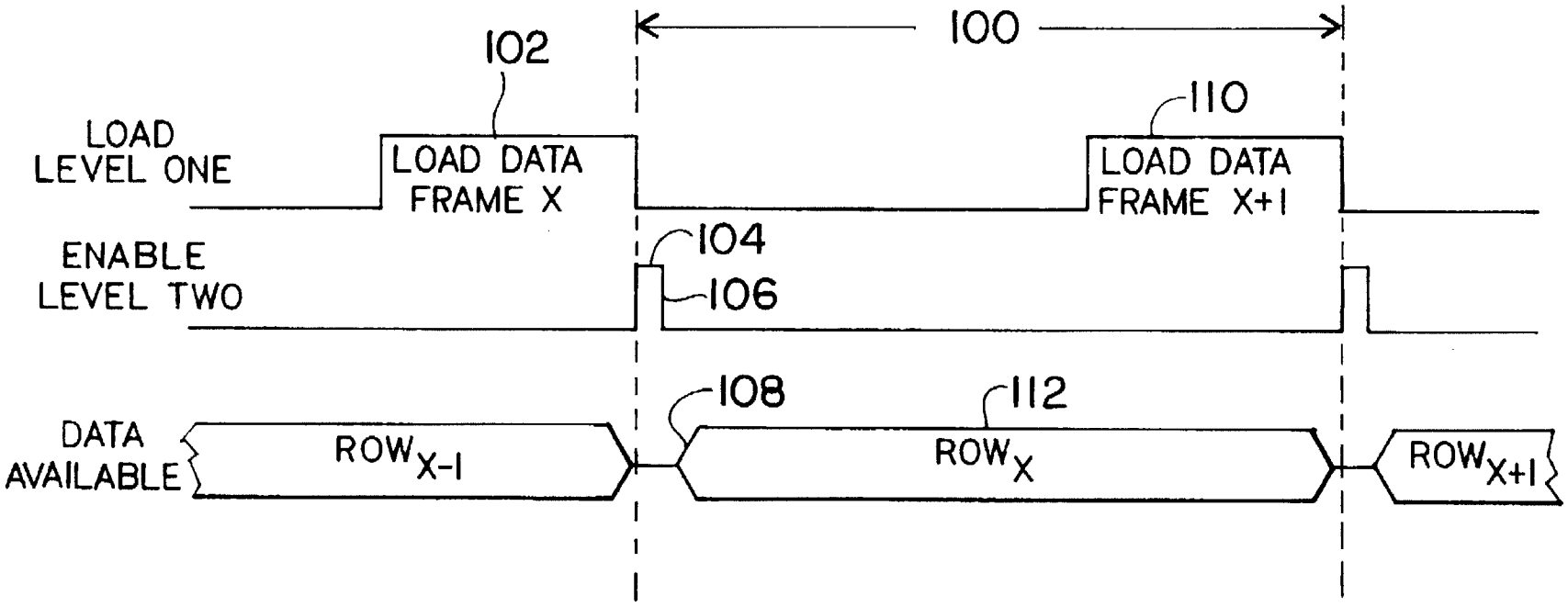
FIG. 4 depicts the timing relationship between loading signal data and data availability in a preferred embodiment of the present invention employing two level multiplexers.

FIG. 4 illustrates the timing relationship between assembly level one, assembly level two, and selected row data display in a preferred embodiment of the present invention. Period 100 of FIG. 4 represents the approximately 32 uS allocated for the addressing of a single row in the VGA format. In the VGA format, a single serial bit is about 40 nS wide. Consequently, it takes approximately 400 nS to populate transmission lines 14A and 14B with a single sub-frame. As previously explained, for ten-bit sub-frames on two transmission lines, 32 signal profiles must be sequentially induced on and captured from transmission lines 14A and 14B for each complete data frame. Because it takes about 400 nS to simultaneously populate each of the transmission lines 14A and 14B with one ten-bit signal profile 70, it requires 32 periods of about 400 nS each or about 12.8 uS to load the storage elements of level one $76_1$–$76_n$ and the corresponding level one storage elements of corresponding assemblies $32_1$–$32_n$ along 14B. With continuing reference to FIG. 4, load period 102 designates the approximately 12.8 uS required to load a single VGA data frame X in the 640 storage elements associated with the level one multiplexers of assemblies $30_1$–$30_n$ and $32_1$–$32_n$. Pulse 104 enables the level two one-to-one multiplexers such as those typified in FIG. 2 for assembly 30, by multiplexers $44_1$–$44_n$ and $46_1$–$46_n$. Consequently, with reference to the example assembly $30_1$ shown in FIG. 2, at pulse 104, the data deposited at level one elements $48_1$–$48_n$ and $50_1$–$50_n$, is conveyed to the storage elements associated with the corresponding column electrodes. Pulse 104 is about 20–30 nS in duration and, for clarity, has been scale magnified in the depiction of FIG. 4. When the level two multiplexers are disabled at timing edge 106, the data from data frame X is localized and available on the column electrodes.

In a display matrix 36 employing TFT technology, a row requires at least about 10–13 uS to reach the ON state. However, most typical row addressing algorithms contemplate turning on selected rows for as long as possible, or in most systems, about 26 uS. Therefore, the present invention has been described as having two multiplexer levels at each assembly site along the transmission lines. The dual level structure allows the data to be pipelined a complete frame at a time and provides, therefore, the data of a complete frame for at least the same time as provided by traditional addressing techniques employing multiple driver packages. When the level two multiplexers are disabled at timing edge 106, the data from data frame X is fixed and available on the columns. Any selected row may be enabled at timing edge 108 to display the data resident on the columns. Because the level two multiplexers isolate the charge storage mechanism of level one from the charge availability on the columns, a subsequent data frame X+1 may be deposited in level one storage during timing period 110 while the data frame X remains available on the columns during display period 112. Therefore, a display row is allowed almost an entire period of about 32 uS to display the data of frame X. Similarly, subsequent frames are loaded into level one storage while the prior data frame is being displayed, thereby providing maximum display time.

In the embodiments described, systems employing black-and-white LCD matrices 36 having a VGA format have been described. As those skilled in the art will appreciate, the pipeline strategy described here is adaptable to a variety of display matrix formats and densities. It should also be apparent that, with faster responding display media, such as those employing FED or plasma technologies, the present invention may be devised to include one level of multiplexer per assembly. Other transmission line addressing algorithms may also be employed with LCD display technology to utilize a single level of multiplexer circuitry per assembly.

Figure 5:
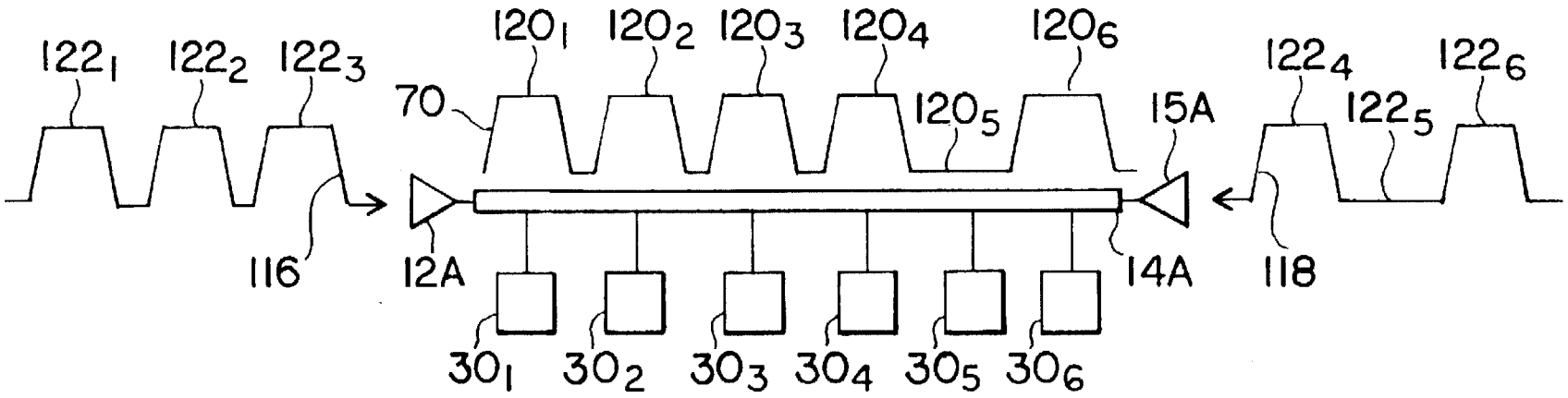
FIG. 5 illustrates a method for dual-ended signal inducement along a controlled signal velocity transmission line in a preferred embodiment of the present invention.
Figure 6:
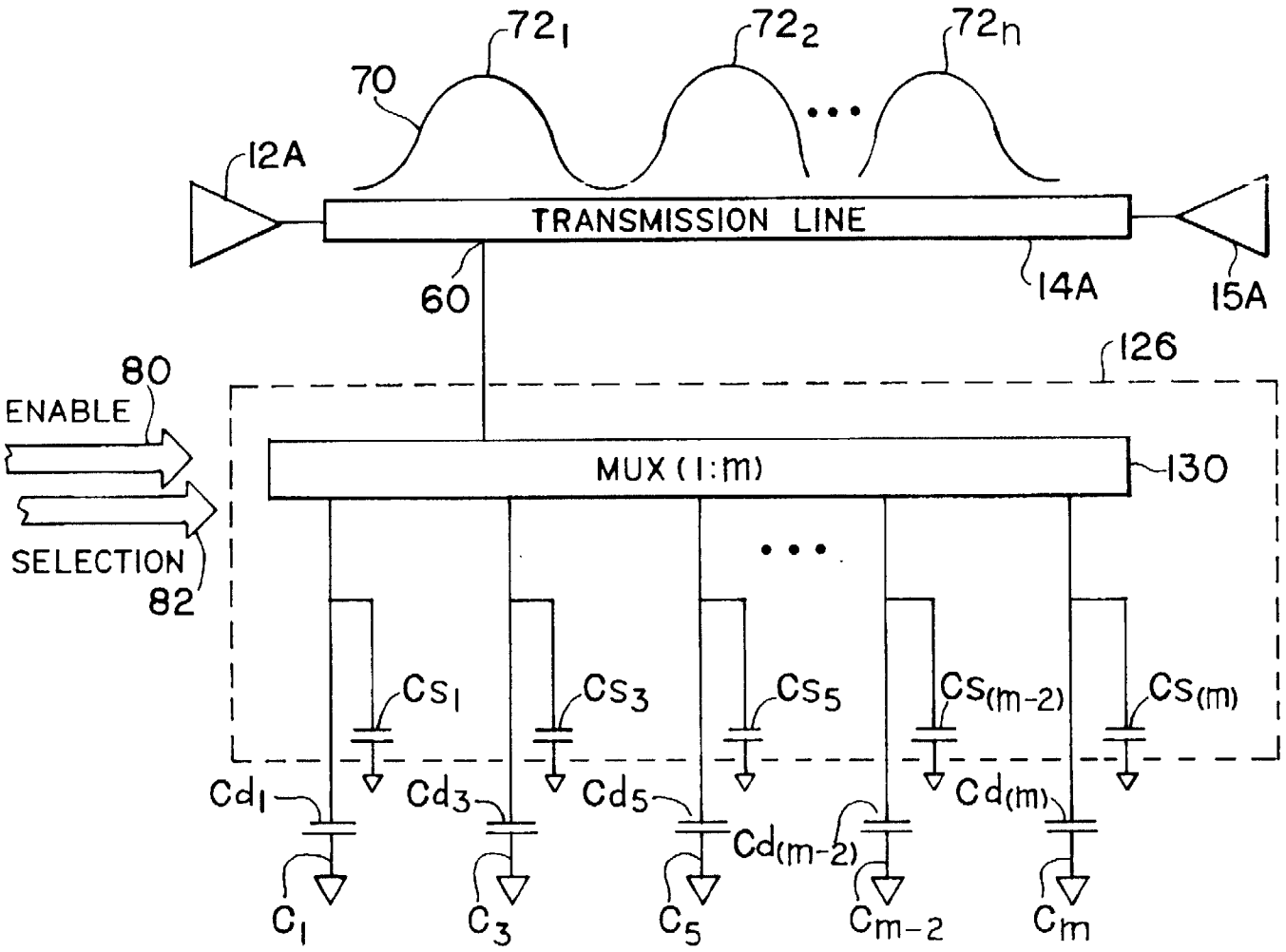
FIG. 6 depicts an exemplar one-level multiplexer assembly in a preferred embodiment of the present invention.
Figure 7:
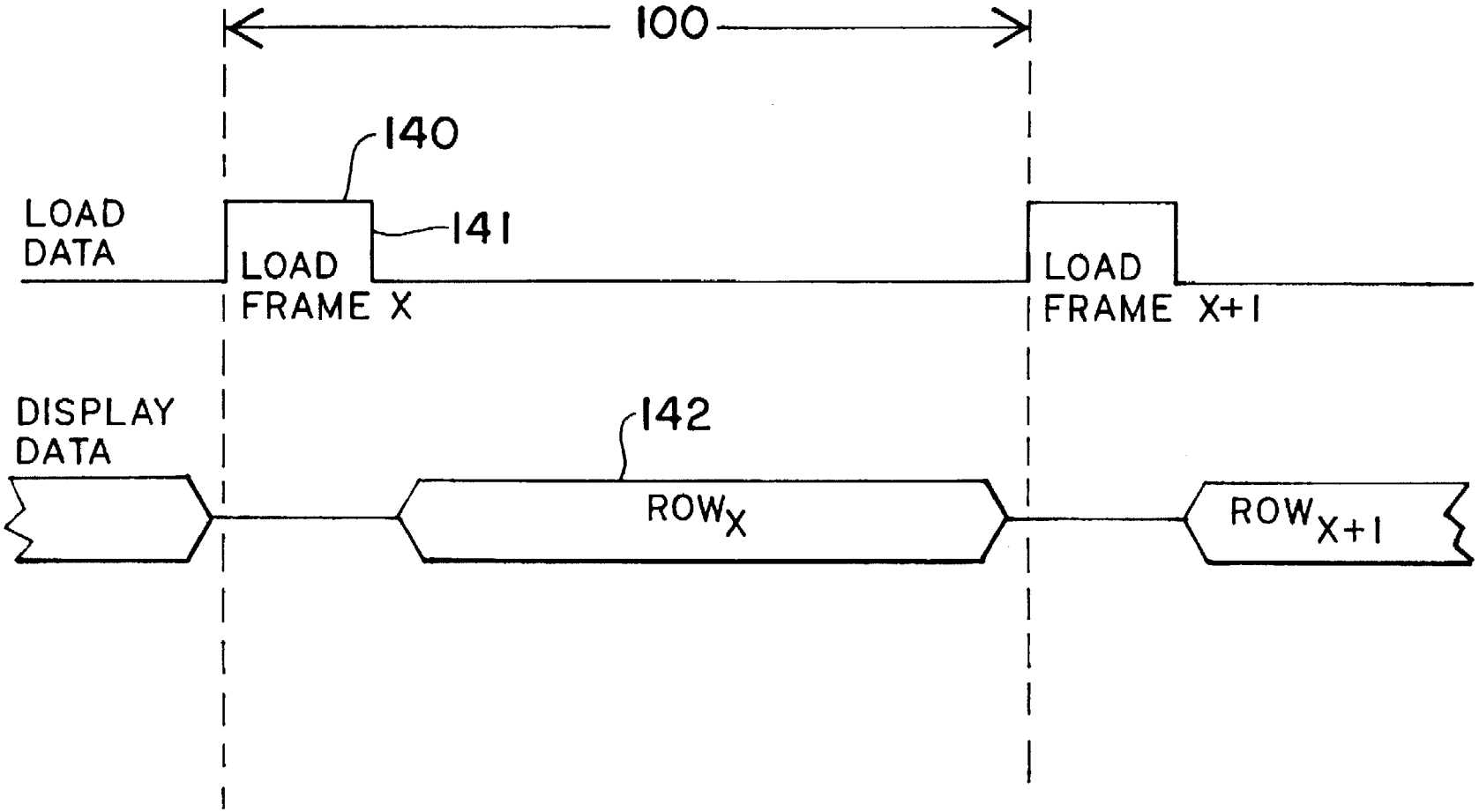
FIG. 7 depicts the timing relationship between data frame loading and data availability in a preferred embodiment of the present invention employing one-level multiplexer assemblies.

For example, if transmission lines 14A and 14B are each populated by contra-directional serial signal inducement at each transmission line end, a signal profile 70, ready for acquisition by assemblies $30_1$–$30_n$ and $32_1$–$32_n$, may be established in approximately one-half the time required by systems using single-ended transmission line signal inducement. Because the transmission line is populated twice as fast with two drivers per transmission line, it takes approximately 6.4 uS to load a complete VGA black-and-white data frame on the display columns. In a system employing one level multiplexer assemblies with dual-ended transmission lines, the data from a complete data frame may be made available, therefore, for the approximately 25.6 uS remaining after 6.4 uS are consumed loading the columns. Plural transmission lines may be loaded in parallel to further reduce the time required to load a data frame. FIGS. 5, 6, and 7 illustrate the structure and timing of a preferred embodiment of the present invention devised to employ dual-ended inducement of signal profiles with one-level multiplexer assemblies.

FIG. 5 illustrates dual-ended inducement of signal profile 70 upon transmission line 14A. Although preferred embodiments typically employ a greater number of multiplexer assemblies with each transmission line in the addressing of LCD matrices, FIG. 5 depicts six assemblies $30_1$–$30_6$ to preserve the clarity of the description. Therefore, in FIG. 5, signal profile 70 comprises six informational bits. As shown in FIG. 5, three-bit sub-frame 116 is induced on transmission line 14A by driver 12A and three-bit sub-frame 118 is simultaneously induced on transmission line 14A by driver 15A. When profile 70 populates transmission line 14A with the informational bits $120_1$–$120_6$ corresponding to the data bits $122_1$–$122_3$ of sub-frame 116 and the data bits $122_3$–$122_6$ of sub-frame 118, multiplexer assemblies $30_1$–$30_6$ are enabled, thus capturing the informational bits of profile 70 for conveyance to selected column electrodes.

FIG. 6 depicts an exemplar one-level multiplexer assembly and its associated charge storage elements in a preferred embodiment of the present invention. Although one-level multiplexer assemblies may be employed with single- or dual-ended signal inducement along transmission lines, the illustration of FIG. 6 shows dual-ended signal inducement along transmission line 14A by drivers 12A and 15A.

With reference to FIG. 6, exemplar multiplexer assembly 126 comprises multiplexer circuitry 130 having a 1-to-m capacity and supplemental storage elements $Cs_1$–$Cs_m$. Those skilled in the art will recognize that "n" multiplexer assemblies such as multiplexer assembly 126 may be integrated to present a single package having "n" inputs and "n×m" outputs to elegantly address a large plurality of electrodes in matrix 36 in accordance with the present invention.

As shown in FIG. 6, assembly 126 captures a designated informational bit from signal profile 70 induced along transmission line 14A by drivers 12A and 15A. As previously described with reference to FIG. 3, signal profile 70 comprises informational bits 721-72n. Assembly 126 is positioned along transmission line 14A at tap site 60 and is positionally designated, therefore, to capture informational bit 721 from signal profile 70. Multiplexer circuitry 130 captures informational bit 721 when sub-bus 80 provides enable signals timed in correspondence with the establishment of profile 70 along transmission line 14A. Multiplexer circuitry 130 directs the captured bit to a selected one of column electrodes C1, C3, * * * Cm in accordance with selection signals provided by sub-bus 82. As depicted in FIG. 6, column electrodes C1, C3, * * * Cm each have an associated inherent distributed storage capacity depicted in FIG. 6 as capacitive elements $Cd_1$, $Cd_3$, * * * Cdm. In a typical LCD matrix 36, elements $Cd_1$, $Cd_3$, * * * Cdm each have a capacitance of approximately 50 pF. The inherent distributed storage capacity of column electrodes may optionally be supplemented as shown in FIG. 6 by the storage elements $Cs_1$–Csm which, in a preferred embodiment, are non-polar capacitors each having capacitance of 100 pF.

As each subsequent sub-frame is induced upon transmission line 14A to sequentially establish a series of signal profiles 70, multiplexer circuitry 130 is sequentially enabled to capture informational bit $72_1$ from each profile and direct each such captured informational bit $72_1$ to one of column electrodes $C_1$–$C_m$ where it is stored in inherent capacitance $Cd_1$–$Cd_m$ (and any supplemental capacitance elements $Cs_1$–$Cs_m$) until a selected row is enabled. In a preferred embodiment, a row is not enabled until all of the informational bits corresponding to a complete data frame have been captured and stored by assembly 126 and the corresponding assemblies along transmission line 14A and any other similar transmission lines such as transmission line 14B, for example, employed in the addressing of display matrix 36. In an alternate preferred embodiment however, a row may be enabled earlier if the final sub-frame is made available coincident with row enablement.

Because captured informational bits are deposited upon selected columns without intermediate storage, assembly 126 is a one-level multiplexer assembly. Consequently, assembly 126 does not directly provide the pipeline ability provided by two-level multiplexer assemblies previously described. Nevertheless, systems devised in accordance with the present invention and employing one-level multiplexer assemblies such as exemplar assembly 126 may provide sufficient time for data display in the addressing of a variety of matrices 36.

FIG. 7 illustrates the timing relationship between employing two dual-ended transmission lines accessed through ten one-level multiplexer assemblies such as exemplar assembly 126 and selected row data display in a preferred embodiment of the present invention. FIG. 7 is best understood with coincident reference to FIGS. 5 and 6.

Period 100 of FIG. 7 represents the approximately 32 uS allocated for the addressing of a single row in the VGA format. In the VGA format, a single serial bit is about 40 nS wide. As earlier described with reference to FIG. 5, when dual-ended signal inducement is used to populate a transmission line, a signal profile 70 may be established in one-half the time required by single-ended signal inducement. Consequently, dual-ended signal inducement populates transmission line 14A with a ten-bit signal profile in about 200 nS rather than the 400 nS required for single-ended inducement. Two dual-end induced transmission lines each having ten-bit capacity, require 32 periods of about 200 nS each or about 6.4 uS to load the column storage elements $Cd_1$–$Cd_m$ and $Cs_1$–$Cs_m$ through one-level multiplexer assemblies in a preferred embodiment.

Load period 140 designates the 6.4 uS required to load 640 bits of a data frame upon the column electrodes of a 640×480 VGA matrix by employing ten single-level multiplexer assemblies such as assembly 126 depicted in FIG. 6. At timing edge 142, the multiplexer assemblies are disabled and the data becomes available on the column electrodes. There remains therefore, approximately 25 uS of the period 100 to display the data stored upon the columns. Data period 142 of FIG. 7 represents the 25 uS available to display data when single-level multiplexer assemblies such as assembly 126 are used in the addressing of a VGA matrix 36. Most traditional addressing strategies provide for about 26 uS for data display. Consequently, the above-described embodiment provides the timing for data availability as found in traditional display systems.

Figure 8:
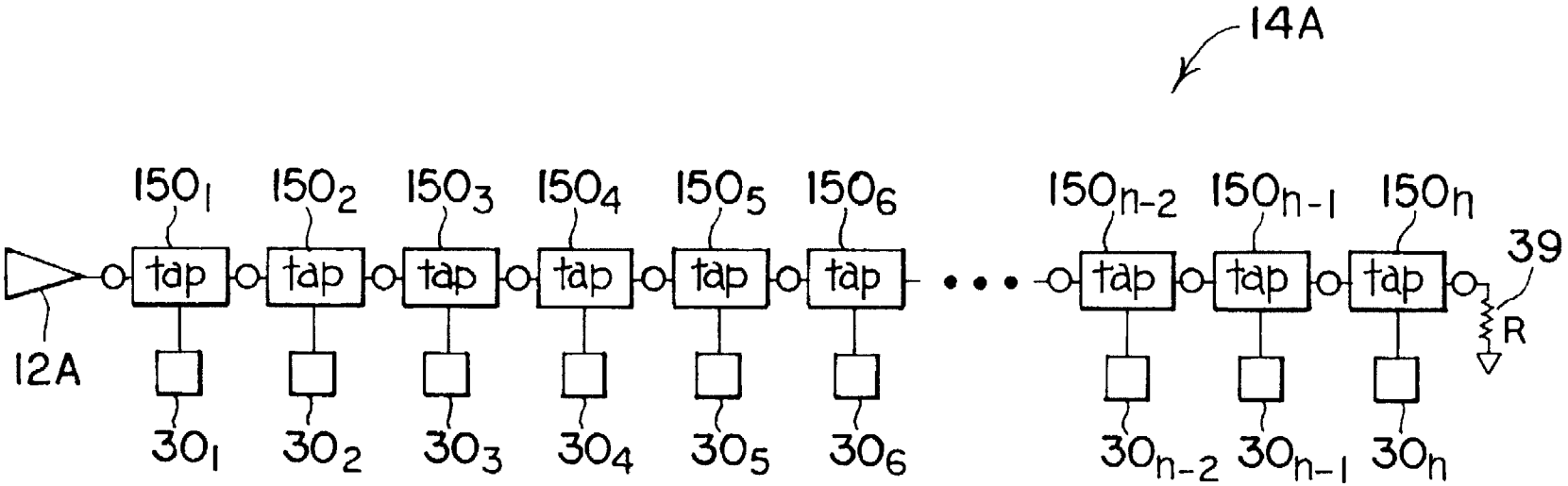
FIG. 8 is a block diagram of a controlled signal velocity transmission line in a preferred embodiment of the present invention.

In the present invention, multiplexer assemblies are positioned along transmission lines in accordance with the propagation velocity of the signals induced along the lines. The velocity of signal propagation along the transmission lines is determined by particular transmission line characteristics and topologies. FIG. 8 is a diagram depicting constituent blocks of transmission line 14A in a preferred embodiment of the present invention. In a preferred embodiment employing available multiplexers, multiplexer assemblies $30_1$–$30_n$ are connected to tap blocks $150_1$–$150_n$ as shown in FIG. 8. When an n-bit sub-frame has been induced on transmission line 14A, multiplexer assemblies $30_1$–$30_n$ are enabled to capture the informational bits of the signal profile corresponding to the induced sub-frame. Multiplexer assemblies $30_1$–$30_n$ gain access to the informational bits of resident signal profiles through corresponding tap blocks $150_1$–$150_n$ In a preferred embodiment employing an integrated multiplexer assembly, a unitary multiplexer may be devised to provide a single package having "n" inputs, each of n inputs accessing signal profiles along transmission line 14A through one of tap blocks $150_1$–$150_n$, and "m" outputs, each of m outputs accessing one of the column electrodes of matrix 36 to be addressed through transmission line 14A.

Figure 9:
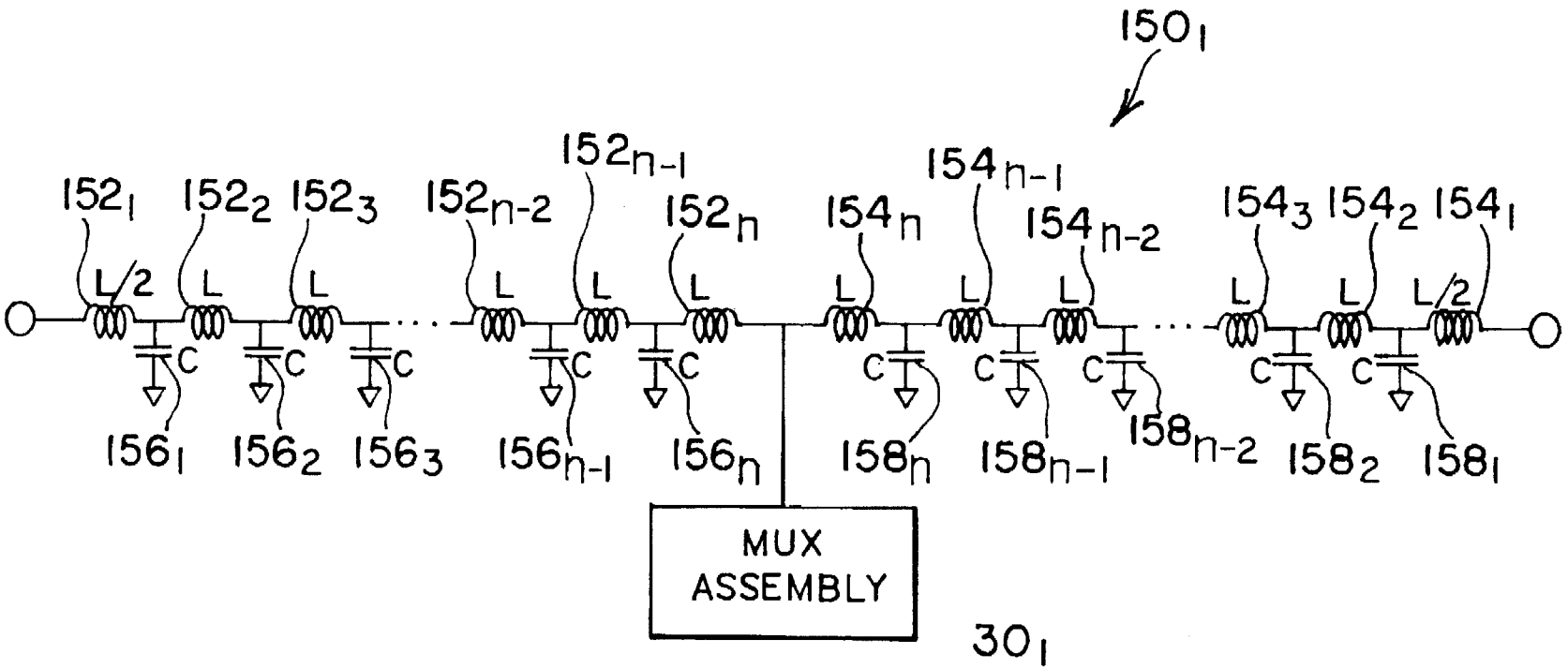
FIG. 9 is an elemental schematic of a tap block within a controlled signal velocity transmission line in a preferred embodiment of the present invention.

FIG. 9 illustrates a schematic model of tap block I 50, of transmission line 14A in a preferred embodiment of the present invention. Transmission lines may be considered to comprise a distributed inductance and capacitance per unit length. The distributed character of transmission line inductance and capacitance may be modeled or effectuated by multiple small-value discrete inductive and capacitive pairs. Consequently, exemplar tap block 150, is depicted as comprising sequential inductive elements $152_1$–$152_n$ and $154_1$–$154_n$ and corresponding capacitive elements $156_1$–$156_n$ and 1581–158n. Inductive elements $152_2$–$152_n$ and $154_2$–$154_n$ are of value L and inductive elements $152_1$ and $154_1$ are of value ½ L. The inductive elements of value ½ L allow sequential aggregation of tap blocks with minimal disruption to propagating signals along transmission line 14A.

Capacitive elements $156_1$–$156_n$ and $158_1$–$158_n$ are of value C. When not enabled, multiplexer assembly $30_1$ presents a capacitance to transmission line 14A equal to C. Consequently, assembly 30, is junctioned with tap block $150_1$ between inductive elements $152_n$ and $154_n$ to minimize disruptive effects otherwise attendant with presentment of the capacitive character of multiplexer assembly $30_1$ to transmission line 14A or the absence of a capacitive element between inductive elements $152_n$ and $154_n$.

At a particular resonant frequency "$f_o$", inductive-capacitive pairs resonate and inhibit, therefore, the subsequent conductive propagation of signals along transmission line 14A. The resonant frequency may be found as follows:

$$f_o = 1/(2\pi\sqrt{LC}) \quad (1)$$

Therefore, as the values L and C become smaller, the bandwidth of transmission line 14A increases. In a preferred embodiment, $f_o$ is approximately 500–600 Mhz. Signal velocity along an ideal transmission line is proportional to the reciprocal of the delay per unit length, where the delay per elemental L - C pair is:

$$\text{delay} => \sqrt{LC} \quad (2)$$

Consequently, transmission lines may be designed to have inductive and capacitive characteristics appropriate for particular signal frequencies and desired signal delays. It has been noted that 26 nS signals may be propagated in accordance with the present invention where C=8.2 pF and L=40 nH and 46 inductive-capacitive pairs are employed per tap block and that 40 nS signals may be propagated in accordance with the principles of this invention where C=12 pF and L=40 nH and 58 inductive-capacitive pairs are employed per tap block. These values are examples only and not to be construed as design limitations required for employment in the present invention. A large variety of capacitive and inductive combinations are configurable to achieve the present invention. For example, transmission line structures suitable for employment in the present invention may present semi-lumped or semi-distributed capacitive and inductive characteristics depending upon transmission line materials and topologies as well as the frequencies of interest.

Ideally, transmission lines exhibit no loss and no signal dispersion. The FIGS of the present description have, thus far, represented transmission lines such as transmission line 14A, for example, as ideal controlled signal velocity propagation paths having straight-line topologies. Such a presentation is useful in depicting the interaction of the elements of systems devised in accordance with the present invention and is an accurate portrayal of ideal transmission lines. Although ideal transmission lines are not available, certain transmission line topologies and compositions mitigate the distortion effects evidenced in real or lossy transmission lines.

Two basic types of distortion are presented by lossy transmission lines. When signals propagate along a lossy transmission line, both the attenuation and propagation velocity vary with signal frequency. Attentuation distortion is the result of variations in signal magnitude with frequency and phase distortion or "dispersion" is the result of variations in phase velocity with frequency.

Well known compensation techniques may be employed to mitigate attenuation distortion in transmission lines employed in preferred embodiments of the present invention. A variety of techniques may mitigate dispersion in transmission lines employed in preferred embodiments of the present invention.

In a real transmission line, the velocity of signal propagation varies with frequency. The frequency components from which an informational bit is comprised travel therefore, at different velocities along the transmission line. Consequently, the informational bit distorts as it travels. Slower moving components of a previous informational bit may lag enough to modulate a following bit, changing its shape and amplitude. If dispersion is extreme, informational bits may distort to render the conveyed information unintelligible. Filters may be interpoised between drivers and transmission lines to damp high frequency components.

Figure 10:
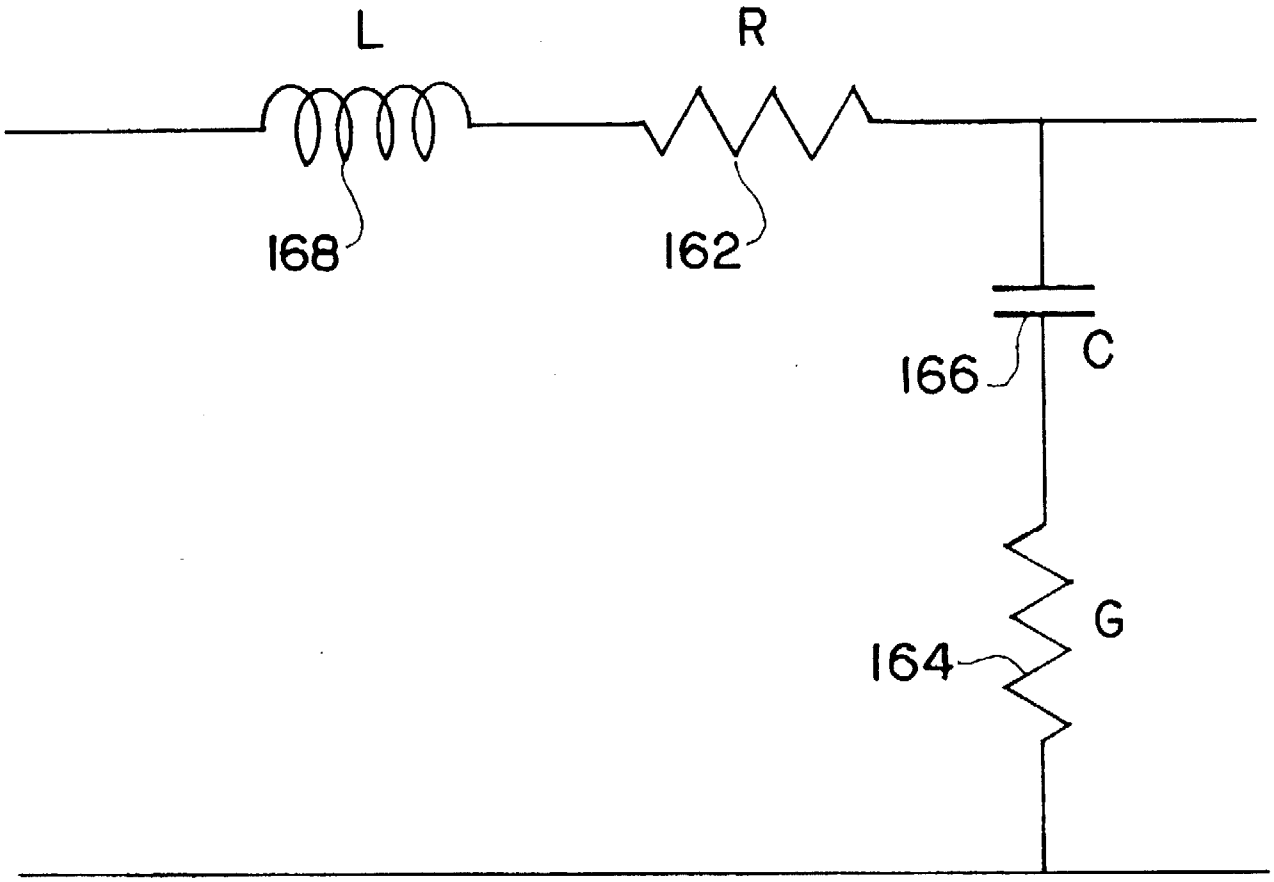
FIG. 10 portrays a schematic model of a lossy transmission line.

FIG. 10 presents a traditional, lossy transmission line model. With reference to FIG. 10, resistance R 162 represents the series loss due to finite conductivity of the conductors and the loss tangent of any magnetic material in or near the conductors. Conductive element G 164 represents conductive characteristics related to dielectric loss tangents. Capacitive element C 166 represents shunt capacitance and inductive element L 168 represents series inductance in the transmission line. The propagation constant is given by:

$$\gamma=\alpha+j\beta \quad (3)$$

which then equals:

$$=\sqrt{(R+j\omega L)(G+j\omega C)} \quad (4)$$

which is approximated by:

$$\approx \omega\sqrt{LC}\ (1 - RG/(4\omega^2 LC) + G^2/(8\omega^2 C^2) + R^2/(8\ \omega^2 L^2)). \quad (5)$$

The term $\omega\sqrt{LC}$ represents the propagation delay of an ideal transmission line. The terms following represent the dispersion. Expression 5 shows that dispersion increases with increasing ratios R/L and G/C. The G/C ratio is minimized with ceramic and ceramic composite materials having low dielectric loss tangents. A straight-line transmission line has a much higher R/L than the same length of line wound into a circle or coil.

An optimum condition occurs when:

$$C/G=L/R \quad (6)$$

When expression 6 is true, the propagation constant becomes non-dispersive.

$$\gamma = \alpha + j\beta = \sqrt{RG} + j\omega\sqrt{LC} \quad (7)$$

Figure 11:
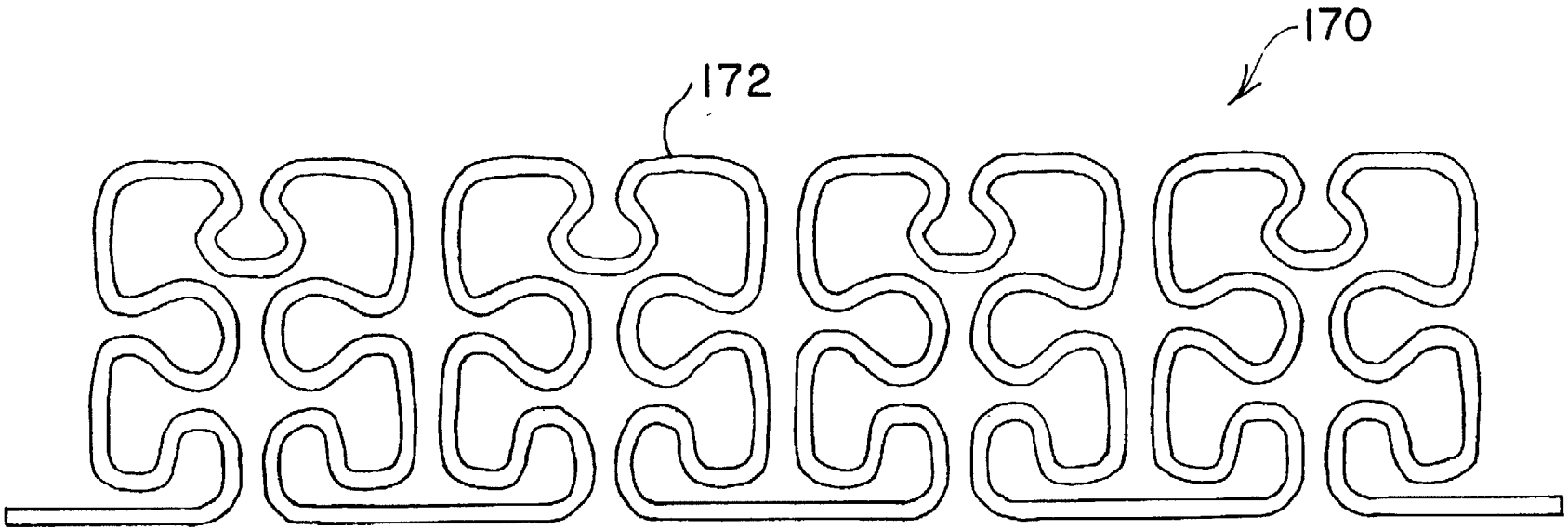
FIG. 11 depicts an inductive trace in a transmission line in a preferred embodiment of the present invention.

FIG. 11 portrays inductive path 172 of a real transmission line 170 employed in preferred embodiments of the present invention. As shown, inductive path 172 is configured as a modified cloverleaf Transmission line 170 may be fashioned as a semi-lumped or semi-distributed circuit.

Figure 12A:
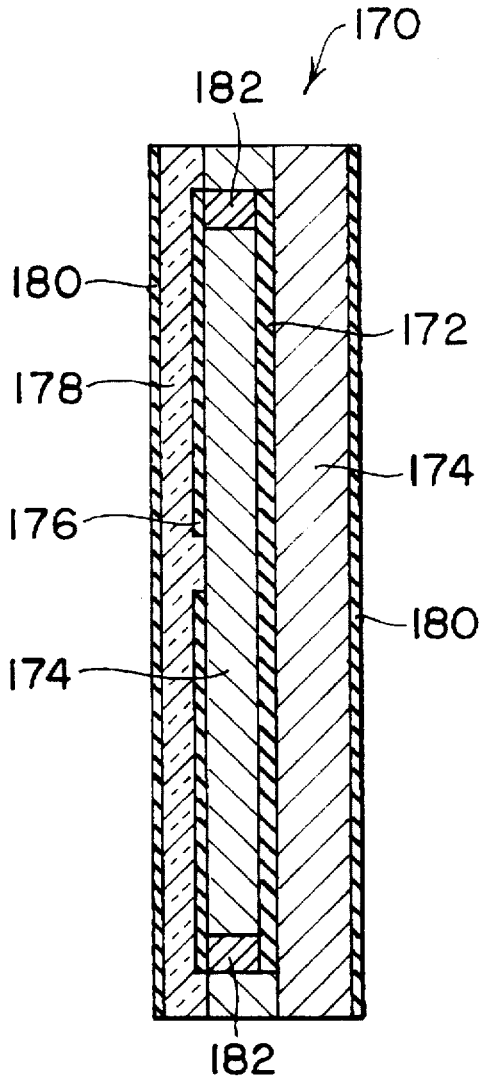
FIGS. 12A and 12B are cross-sectional views of a transmission line devised as semi-lumped and semi-distributed circuits in a preferred embodiment of the present invention.
Figure 12B:
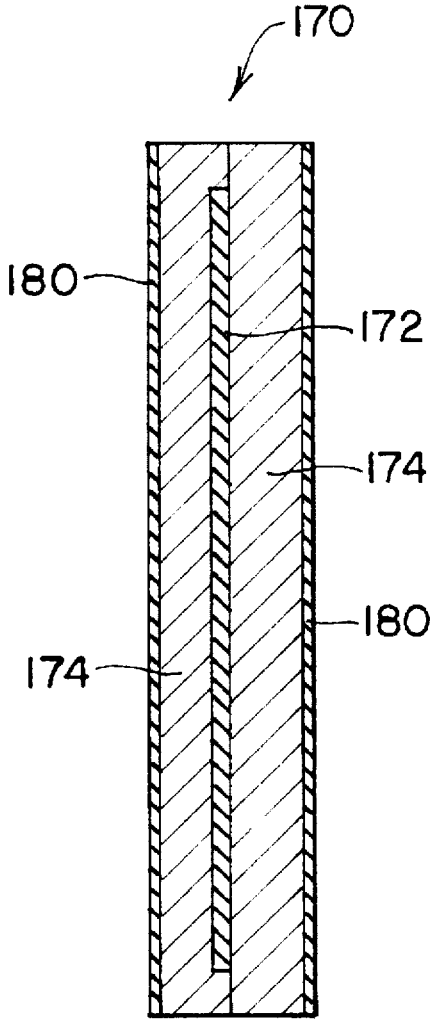

FIGS. 12A and 12B are cross-sectional views of transmission line 170 fashioned in semi-lumped and semi-distributed circuits respectively. With reference to FIG. 12A, transmission line 170 having an inductor pattern 172 is shown employing ferrite layers 174. Ferrite increases the Q of transmission lines and, in preferred compositions, exhibits flat permittivity and permeability within 1% over a frequency range of from 5–100 Mhz. Ferrite becomes very lossy above 100 Mhz and therefore, helpfully damps high frequencies. Ferrite laminar materials adapted to fusion laminate processes are employed in a preferred embodiment of the present invention. Other low temperature ferrite materials have been employed to advantage in preferred embodiments of the present invention. Preferrable materials have shown over the frequency range, an initial permeability of between 4–10, a magnetic loss tangent of less than or equal to 0.003, and a dielectric constant of between 10–40. A dielectric loss tangent of less than 0.003 is preferred with semi-distributed circuits and a dielectric loss tangent of less than 0.01 is preferred for semi-lumped circuits. Resistivity greater than $10^5$ is preferred and a coercive force of greater than 1500 A/m is desired.

Expression 7 is employed in choosing material characteristics of the ferrite and copper employed as inductive path 172 in a preferred embodiment. By varying transmission line cross-section and therefore, RIL, capacitance per element, inductance per element, and in the case of semi-lumped configurations, the ratio of internal to external capacitance and therefore, C/G, expression 7 is optimized over the frequency range to further limit dispersion.

Capacitor pads 176 are employed in semi-lumped circuit transmission line 170 and dielectric layer 178 completes the capacitive elements. Ground layers 180 complete transmission line 170 and semi-lumped elements are interconnected through vias 182.

FIG. 12B illustrates a cross-sectional view of transmission line 170 devised as a semi-distributed circuit. Ferrite layer 174 surrounds inductive path 172 and ground layers 180 complete transmission line 170.

Figure 13:
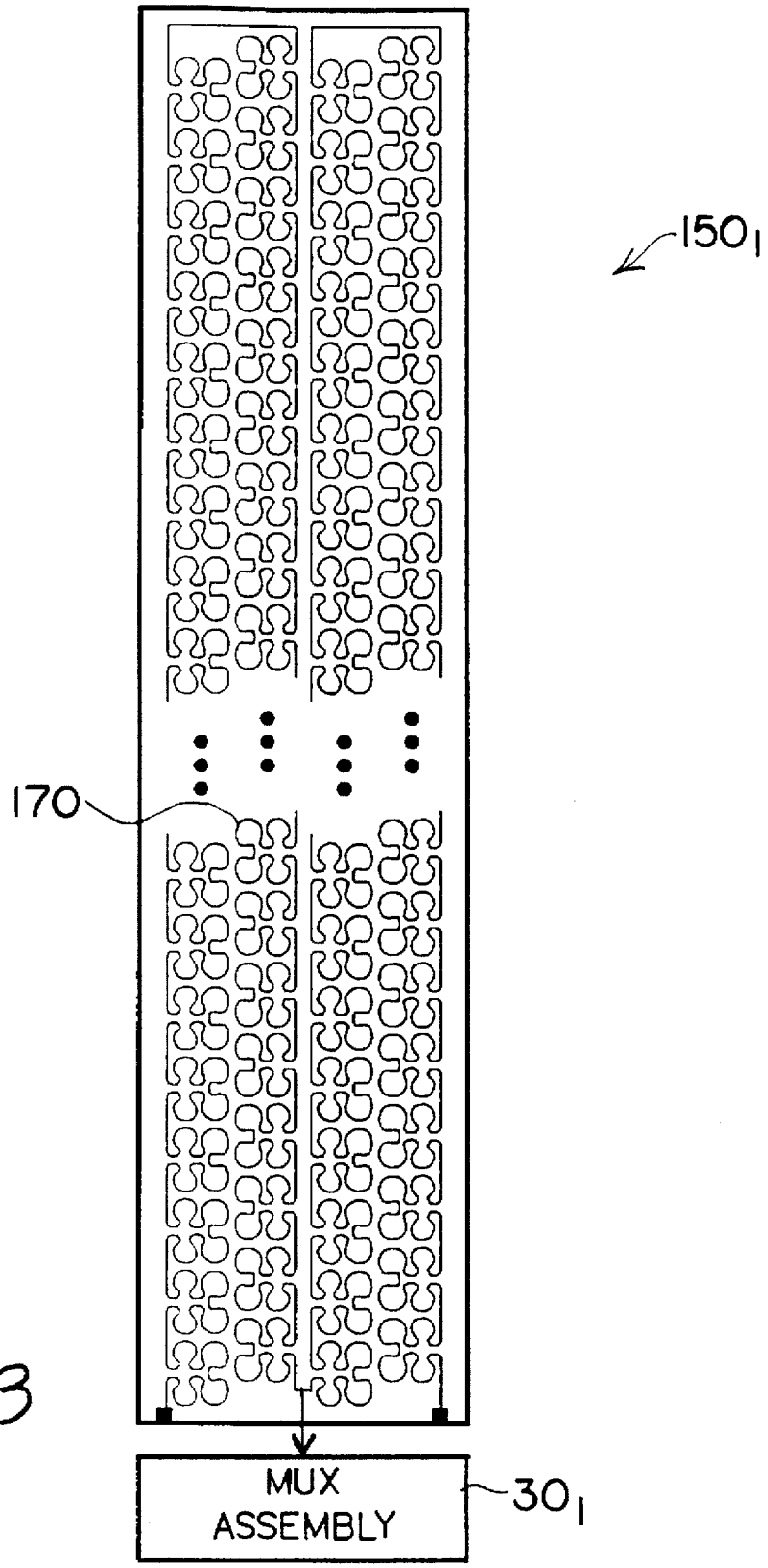
FIG. 13 illustrates a tap block employing the inductive trace transmission line of FIG. 11.

FIG. 13 illustrates transmission line 170 employed to implement a 26 nS tap block $150_1$ in a preferred embodiment of the present invention. As shown in FIG. 13, exemplar multiplexer assembly $30_1$ is appended to tap block $150_1$.

A wide variety of matrix devices may employ the present invention to advantage. For example, multiple transmission lines and a variety of multiplexer combinations may be employed to address color-responsive matrix displays. Both rows and columns may be addressed with transmission lines. It will be apparent to those skilled in the art that the invention may be embodied in a variety of specific forms without departing from its essential characteristics or its spirit. The described embodiments are only illustrative and not restrictive and the scope of the invention is, therefore, to be indicated by the following claims.

We claim:

1. A system for addressing a set of data display elements in a display of a type that displays arbitrary information patterns, the system comprising:

a display matrix having overlapping first and second electrodes;

a set of data display elements in electrical communication set of the first electrodes, said electrical communication controlled by a selected second electrode, a controlled signal velocity propagation transmission line;

a data signal driver for inducing a sub-frame of data upon said transmission line as a signal profile comprising informational bits distributed along the transmission line;

a first level of multiplexer circuitry positioned along the transmission line to capture the informational bits from the said signal profile;

a first enable signal generator to generate and apply a set of enable signals to said first level of multiplexer circuitry to precipitate capture of the informational bits a set of storage elements associated with said first level of multiplexer circuitry to temporarily store said captured informational bits, a selection signal generator to generate and apply selection signals to said first level of multiplexer circuitry to direct temporary storage of said captured informational bits in designated ones of the set of storage elements;

a second level of multiplexer circuitry interposed between the set of storage elements and said set of the first electrodes;

a second enable signal generator to generate and apply a set of load signals to the second level of multiplexer circuitry to precipitate conveyance of said temporarily stored informational bits from the set of storage elements to said selected set of the first electrodes;

a display signal generator to generate and apply a set of display signals to the selected second electrode to enable the electrical communication between the set of display elements and the set of first electrodes to precipitate conveyance of the temporarily stored informational bits from said selected set of first electrodes to the set of display elements.

2. A system for addressing a set of data display elements in a display of a type that displays arbitrary information patterns, the system comprising:

a matrix field comprising overlapping first electrodes and a set of second electrodes;

plural data display elements in electrical communication with the first electrodes;

a selected second electrode arranged to control the electrical communication between the plural data display elements and the first electrodes;

a controlled signal propagation velocity transmission line;

a data signal driver for sequentially generating and applying to said transmission line a frame of data having N bits, said frame of data being comprised of M sub-frames of data sequentially composed as M signal profiles upon said transmission line during a sequence of M unique time windows, each of said M signal profiles being comprised of N/M informational bits;

N/M multiplexer assemblies positioned along the controlled signal velocity transmission line and having thereby, selectable access the N/M informational bits of each of M signal profiles;

N/M banks of first electrodes, each of said N/M banks of first electrodes being connected to corresponding ones of said N/M multiplexer assemblies and each of said N/M banks comprising M unique first electrodes having associated charge storage capacity enabling temporary storage of data;

a first control circuit for generating and applying enable signals to said N/Ni multiplexer assemblies to control thereby the enablement of said N/Ni multiplexer assemblies in accordance with the sequential composition of said M signal profiles upon said transmission line to capture said N/M informational bits by the N/M multiplexer assemblies;

a selection circuit for generating and applying digital selection signals to said N/M multiplexer assemblies to direct storage of said captured N/M informational bits to said designated ones of M unique first electrodes of each of said N/M banks of first electrodes for temporary storage;

a display enable signal generator for generating and applying display signals to the selected second electrode to enable the electrical communication between the plural data display elements and the first electrodes to convey the temporarily stored N/M informational bits from the designated ones of M unique first electrodes to corresponding designated ones of the plural data display elements.

* * * * *

UNITED STATES PATENT AND TRADEMARK OFFICE

CERTIFICATE OF CORRECTION

PATENT NO. : 5,757,351
DATED : May 26, 1998
INVENTOR(S) : Lin, et al.

It is certified that error appears in the above-identified patent and that said Letters Patent is hereby corrected as shown below:

Column 5, line 42, between the textual "FIG. 11 depicts" and "an inductive trace," please insert --a plan view of--.

Column 6, line 34, between the textual "In the system of FIG. 1," and "when display matrix 36, ' please insert --as shown in FIGS. 2 and 6--.

Column 6, lines 36, please replace "C1, C3, C5, * * * C639" with -- $C_1$, $C_3$, $C_5$, * * * $C_{639}$ --.

Column 6, line 38, please replace "C2, C4, C6 * * * C640" with -- $C_2$, $C_4$, $C_6$, * * * $C_{640}$ --.

Column 8, line 10, please replace "$48_1$-$48_{16}$" with --$48_1$-$48_n$--.

Column 9, line 8, please replace "$48_1$-$48_{16}$" with --$48_1$-$48_n$--.

Column 9, line 28, please replace "$48_1$-$48_{16}$" with --$48_1$-$48_n$--.

Column 10, line 11, please replace "$48_1$-$48_{16}$" with --$48_1$-$48_n$--.

Column 12, line 42, please replace "$122_3$-$122_6$" with --$122_4$-$122_6$--.

Column 12, line 66, please replace "721-72n" with --$72_1$-$72_n$--.

Column 13, line 2, please replace "721" with --$72_1$--.

Column 13, line 3, please replace "721" with --$72_1$--.

UNITED STATES PATENT AND TRADEMARK OFFICE

CERTIFICATE OF CORRECTION

PATENT NO. : 5,757,351
DATED : May 26, 1998
INVENTOR(S) : Lin, et al.

It is certified that error appears in the above-identified patent and that said Letters Patent is hereby corrected as shown below:

Column 13, line 7, please replace "C1, C3 * * * Cm" with --$C_1$, $C_3$, * * * $C_m$--.

Column 13, line 9, please replace "C1, C3, * * * Cm" with --$C_1$, $C_3$, * * * $C_m$--.

Column 13, line 11, please replace the matter "Cdm" with --$CD_m$--.

Column 13, line 12, please replace "$Cd_1$, $CD_3$, * * * Cdm" with --$Cd_1$, $CD_3$, * * * $Cd_m$--.

Column 13, line 16, please replace "-Csm" with --$Cs_m$--.

Column 14, line 3, please replace "142" with --141--.

Column 14, line 48, please replace "1581-158n" with --$158_1$-$158_n$--.

Signed and Sealed this

First Day of June, 1999

*Attest:*

Q. TODD DICKINSON

*Attesting Officer*

*Acting Commissioner of Patents and Trademarks*